US012618123B2

(12) United States Patent
Binder et al.

(10) Patent No.: US 12,618,123 B2
(45) Date of Patent: May 5, 2026

(54) PIECE OF JEWELRY

(71) Applicant: EGF—EDUARD G. FIDEL GMBH, Pforzheim (DE)

(72) Inventors: Kai-F. Binder, Pforzheim (DE); Avni Bajraktari, Pforzheim (DE)

(73) Assignee: EGF—EDUARD G. FIDEL GMBH, Pforzheim (DE)

( * ) Notice: Subject to any disclaimer, the term of this patent is extended or adjusted under 35 U.S.C. 154(b) by 593 days.

(21) Appl. No.: 17/800,674

(22) PCT Filed: Jun. 16, 2021

(86) PCT No.: PCT/EP2021/066306
§ 371 (c)(1),
(2) Date: Aug. 18, 2022

(87) PCT Pub. No.: WO2022/033749
PCT Pub. Date: Feb. 17, 2022

(65) Prior Publication Data

US 2023/0295773 A1 Sep. 21, 2023

(30) Foreign Application Priority Data

Aug. 12, 2020 (DE) ..... 10 2020 121 225.9

(51) Int. Cl.

| | |
|---|---|
| ***C22C 5/02*** | (2006.01) |
| ***A44C 27/00*** | (2006.01) |
| ***B22D 11/00*** | (2006.01) |
| ***B22D 25/02*** | (2006.01) |
| ***B22D 25/06*** | (2006.01) |
| ***C22C 1/02*** | (2006.01) |

(52) U.S. Cl.
CPC ..... *C22C 5/02* (2013.01); *A44C 27/003* (2013.01); *B22D 11/001* (2013.01); *B22D 25/026* (2013.01); *B22D 25/06* (2013.01); *C22C 1/02* (2013.01)

(58) Field of Classification Search
None
See application file for complete search history.

(56) References Cited

U.S. PATENT DOCUMENTS

2008/0243244 A1* 10/2008 Bucker ..... A61F 2/91 623/1.53
2017/0241003 A1 8/2017 Na et al.

FOREIGN PATENT DOCUMENTS

| | | | | |
|---|---|---|---|---|
| DE | 3414128 | A1 | 12/1985 | |
| DE | 20004915 | U1 * | 7/2001 | ..... A61L 27/047 |
| DE | 100 27 605 | A1 | 12/2001 | |
| DE | 603 10 555 | T2 | 12/2007 | |
| DE | 20 2010 011 820 | U1 | 11/2010 | |
| DE | 10 2011 009 625 | A1 | 3/2012 | |
| EP | 1 650 316 | A1 | 4/2006 | |
| JP | 60-258435 | A | 12/1985 | |
| JP | 63-169345 | A | 7/1988 | |
| RU | 2 170 280 | C1 | 7/2001 | |
| RU | 2 366 739 | C1 | 9/2009 | |
| RU | 2 405 050 | C1 | 11/2010 | |

OTHER PUBLICATIONS

English language machine translation of DE-20004915. Generated Jan. 15, 2025. (Year: 2025).*
DIN EN ISO 8654, May 2020, "Jewellery—Colours of gold alloys—Definition, range of colours and designation (ISO 8654:2018 + Amd 1:2019); German version EN ISO 8654:2018 + A1:2019".
International Search Report, issued in PCT/EP2021/066306, dated Sep. 29, 2021.
Rapson, "The Metallurgy of the Coloured Carat Gold Alloys", Gold Bull, 1990, vol. 23, No. 4, pp. 125-133.
DIN EN ISO 8654, May 2020, "Jewellery—Colours of gold alloys—Definition, range of colours and designation (ISO 8654:2018 + Amd 1:2019); German version EN ISO 8654:2018 + A1:2019", with a partial English translation.
Cretu et al., "Coloured Gold Alloys," Gold Bulletin, vol. 32, No. 4, 1999, pp. 115-126.
Taiwanese Office Action and Search Report for Taiwanese Application No. 110126049, dated Aug. 29, 2024, with an English translation.
Korean Office Action for Korean Application No. 10-2022-7028943, dated Aug. 18, 2025, with English translation.

* cited by examiner

*Primary Examiner* — Sally A Merkling
(74) *Attorney, Agent, or Firm* — Birch, Stewart, Kolasch & Birch, LLP

(57) ABSTRACT

A piece of jewelry having a copper-containing gold alloy consists of 58.5 to 58.7 wt. % gold, 26.9 to 32.6 wt. % copper, 5.7 to 10.7 wt. % silver, 1.0 to 3.0 wt. % palladium, and a remainder containing 0.7 to 2.2 wt. % zinc.

10 Claims, No Drawings

PIECE OF JEWELRY

The invention relates to a jewellery body, such as a piece of jewellery, in particular a ring-shaped piece of jewellery, a part of a piece of jewellery or a semi-finished product for manufacturing a piece of jewellery, according to the generic term of claim 1, a jewellery alloy for manufacturing such a jewellery body and a method for manufacturing the jewellery alloy. The jewellery body is manufactured from a gold alloy containing copper.

From DE60310555T2 an alloy for manufacturing watch, ornamental and jewellery articles is known, which has a gold content of at least 75 wt. % and a copper content of at least 14 wt. %. It is further described how a colour shade from red via pink to yellow can be achieved in such gold alloys depending on the contents of copper and silver.

The disadvantage of the known alloys is that they are relatively expensive to produce due to the high gold content. In addition, there is a need on the jewellery market for alloys which, in addition to the known coloured gold alloys, make new colour variations possible, in particular in the manufacture of gold jewellery, and which are relatively inexpensive to produce.

The object of the invention is therefore to avoid the disadvantages mentioned in a generic jewellery body and to provide a new colour scheme.

This object is achieved by the jewellery body made of a copper-containing gold alloy with the features of claim 1. The gold alloy consists of at least 58.5 to a maximum of 58.7 wt. % gold, at least 26.9 to a maximum of 32.6 wt. % copper, at least 5.7 to a maximum of 10.7 wt. % silver, at least 1.0 to a maximum of 3.0 wt. % palladium, and a balance having at least 0.7 to a maximum of 2.2 wt. % zinc, whereby a jewellery body with a novel colour shade that can be referred to as champagne-coloured is obtained.

In a particularly advantageous embodiment, the alloy consists of 58.6 wt. % gold, 29.0 to 29.5 wt. % copper, 8.5 to 9.0 wt. % silver, 1.9 to 2.1 wt. % palladium, and a balance having 1.4 and 1.5 wt. % zinc. With such a composition, a particularly intense champagne colour can be achieved and particularly good workability of the gold-copper alloy can be ensured. In addition, the gold alloy with the champagne colour shade can be manufactured relatively inexpensively in this way.

Furthermore, the above object is achieved by a method in which the zinc content of the alloy is at least partially obtained by melting brass together with the other constituents. In this way, the zinc content of the melt can be produced in a particularly simple manner.

In this case, the molten brass is advantageously formed by Cu63Zn37 brass, whereby the desired content of zinc can be melted particularly easily and in an exact quantity.

After the manufacture of the corresponding melt, it is advantageous if this is cast by hand in order to be able to manufacture also small or particularly filigree jewellery bodies in the champagne shade.

Alternatively or additionally thereto, the melt can be supplied to a continuous casting method, particularly in the case of larger quantities, in order to be able to manufacture, for example, semi-finished products that can be used for later processing into pieces of jewellery, such as for the manufacture of fully or partially champagne-coloured jewellery rings.

A preferred composition of the melt for manufacturing the jewellery alloy and the jewellery body with a particularly radiant champagne colour shade is given below:

EXAMPLE 58.6 wt. % gold,
26.7 wt. % copper,
8.7 wt. % silver,
2.0 wt. % palladium,
4.0 wt. % CuZn37 brass.

The invention claimed is:

1. A piece of jewelry, comprising:
a jewelry body made of a copper-containing gold alloy, wherein the gold alloy consists of
58.5 to 58.7 wt. % gold,
26.9 to 29.5 wt. % copper,
5.7 to 10.7 wt. % silver,
1.0 to 3.0 wt. % palladium, and
a balance having 0.7 to 2.2 wt. % zinc based on the total composition,
wherein the gold alloy has a champagne color.

2. The piece of jewelry according to claim 1, wherein the gold alloy consists of
58.6 wt. % gold,
29.0 to 29.5 wt. % copper,
8.5 to 9.0 wt. % silver,
1.9 to 2.1 wt. % palladium, and
a balance having 1.4 and 1.5 wt. % zinc based on the total composition.

3. A copper-containing gold alloy for manufacturing the piece of jewelry according to claim 1, consisting of:
58.5 to 58.7 wt. % gold,
26.9 to 29.5 wt. % copper,
5.7 to 10.7 wt. % silver,
1.0 to 3.0 wt. % palladium, and
a balance having 0.7 to 2.2 wt. % zinc based on the total composition wherein the gold alloy has a champagne color.

4. A method for manufacturing the copper-containing gold alloy according to claim 3, wherein the method comprises melting brass together with gold, copper, silver, and palladium to form a melt, and wherein the zinc content is obtained from the brass.

5. The manufacturing method according to claim 4, wherein the brass in the form of CuZn37 is melted.

6. The manufacturing method according to claim 4, wherein, after manufacturing the copper-containing gold alloy, the melt is cast by hand.

7. The manufacturing method according to claim 4, wherein, after manufacturing the copper-containing gold alloy, the melt is supplied to a continuous casting method.

8. A copper-containing gold alloy for manufacturing the piece of jewelry according to claim 2, consisting of:
58.6 wt. % gold,
29.0 to 29.5 wt. % copper,
8.5 to 9.0 wt. % silver,
1.9 to 2.1 wt. % palladium, and
a balance having 1.4 and 1.5 wt. % zinc based on the total composition wherein the gold alloy has a champagne color.

9. The manufacturing method according to claim 5, wherein, after manufacturing the copper-containing gold alloy, the melt is cast by hand.

10. The manufacturing method according to claim 5, wherein, after manufacturing the copper-containing gold alloy, the melt is supplied to a continuous casting method.

* * * * *